US005215479A

United States Patent [19]

Araki et al.

[11] Patent Number: 5,215,479

[45] Date of Patent: Jun. 1, 1993

[54] FUSE BOX

[75] Inventors: Mamoru Araki; Masaaki Sugiyama, both of Shizuoka, Japan

[73] Assignee: Yazaki Corporation, Tokyo, Japan

[21] Appl. No.: 757,396

[22] Filed: Sep. 10, 1991

[30] Foreign Application Priority Data

Sep. 12, 1990 [JP] Japan ..... 2-95099[U]

[51] Int. Cl.[5] ..... H01R 13/68

[52] U.S. Cl. ..... 439/622; 174/186

[58] Field of Search ..... 337/131, 186, 194, 195, 337/198; 439/621, 622

[56] References Cited

U.S. PATENT DOCUMENTS 4,224,592 9/1980 Urani et al. .

4,238,140 12/1980 Cairnes et al. ..... 439/621 X

FOREIGN PATENT DOCUMENTS 61-136454 8/1986 Japan .

*Primary Examiner*—Eugene F. Desmond

*Attorney, Agent, or Firm*—Armstrong, Westerman, Hattori, McLeland & Naughton

[57] ABSTRACT

A fuse box has a fuse cavity for receiving the body of a blade type fuse having blade-like male terminals projecting from the body into an insertion direction of the blade type fuse. The body of blade type fuse has opposed ends extending into the insertion direction and a side rib provided on each of the opposed ends and extending into the insertion direction. The fuse cavity has opposed walls for receiving therebetween the opposed ends of the blade type fuse when the blade type fuse is inserted. The fuse cavity also has two pairs of second ribs on the opposed walls, each pair being positioned to define a receiving groove therebetween for receiving the side rib of the blade type fuse.

4 Claims, 2 Drawing Sheets

FUSE BOX

BACKGROUND OF THE INVENTION

1. Field of the Invention

The present invention relates to improvement of a fuse box installed on vehicles such as automobiles.

2. Description of the Related Art

A conventional on-vehicle fuse box has a matrix of fuse receiving walls. FIGS. 4 and 5 show one such receiving wall a that defines a fuse cavity b for receiving a blade type fuse and a receptacle cavity b1 for accommodating a double receptacle c. The double receptacle c has female type electrical contacts c1 and c2 in one piece construction. The contact c1 receives a male terminal d1 of a bus bar d upwardly projecting from the bottom of the fuse box while the contact c2 receives a male contact e1 of the blade type fuse e.

The contact c2 has inwardly folded resilient contacts c' and c'' between which the male terminal e1 of the blade type fuse e is inserted. The double receptacle c is housed in the receptacle cavity b1 with clearances f and f' between the inner wall of the receptacle cavity b1, so that the contact c2 is allowed to displace outwardly of resilient contact c'' to relieve the double receptacle c of excessive mechanical strain. However, the blade type fuse e is sometimes inadvertently wrongly inserted into the clearance f, in which case the blades e1 are deformed as shown in FIG. 5 allowing further insertion of head portion e2 of the blade type fuse e into the fuse cavity b. The head goes into the cavity while being in normal attitude. It is difficult to determine by appearance whether the fuse is normally inserted or wrongly inserted. This wrong insertion of blade type fuse is a source of abnormal heat generation at the contacts.

SUMMARY OF THE INVENTION

The present invention was made in view of the aforementioned drawbacks and an object of the invention is to provide a fuse box in which an improper insertion of blade type fuse is effectively prevented.

A blade type fuse has a substantially plate-like body and two blade-like male terminals projecting outwardly from the body. The plate-like body has opposed ends and a rib provided on each of the opposed ends. The ribs extend in the insertion direction of the plate-like fuse. A fuse box has a fuse cavity for receiving the plate-like body of the blade type fuse therein. The fuse cavity has a pair of wrong insertion detecting ribs at each longitudinal end of the cavity. The wrong insertion detecting ribs are positioned in opposing relation with each other so as to define a receiving groove therebetween. Each rib has a beveled guiding surface so that the rib of the blade type fuse is guided into the groove when inserted into the fuse cavity.

BRIEF DESCRIPTION OF THE DRAWINGS

Features and other objects of the invention will be more apparent from the description of the preferred embodiment with reference to the accompanying drawings in which.

DETAILED DESCRIPTION OF THE PREFERRED EMBODIMENT

Figure 1:
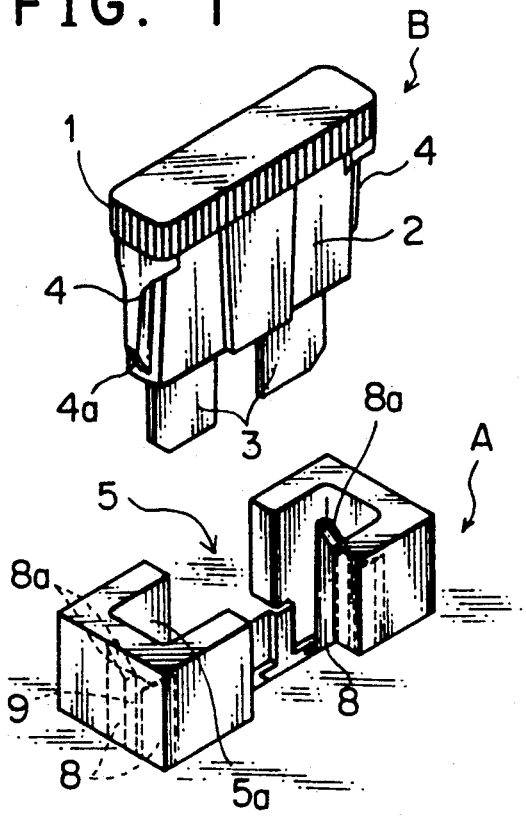
FIG. 1 is a perspective view of an embodiment of the present invention.
Figure 2:
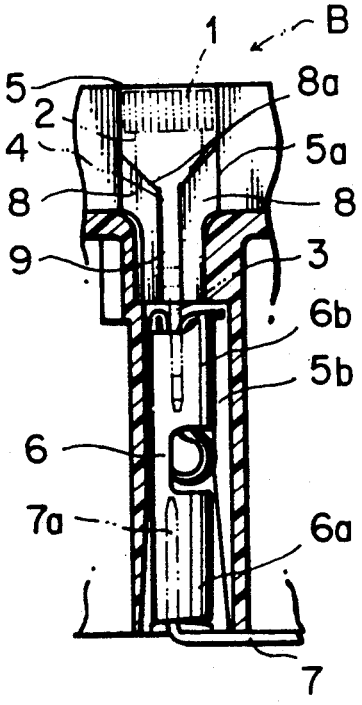
FIG. 2 is a cross-sectional view of FIG. 1, showing an essential part of a fuse box when a blade type fuse is inserted.

Referring to FIGS. 1 and 2, a blade type fuse B has a substantially plate-like body 2 having a head 1 on the top thereof and two blade-like male terminals 3 and 3 projecting downwardly from the body 2. Within the body 2 is connected a fuse element (not shown) between the terminals 3 and 3. The body 2 has at its lateral ends ribs 4,4 that extend in the direction in which the blade-like fuse is inserted. The respective rib 4 has a beveled guide surface 4*a* at its forward end for properly guiding the fuse into a fuse cavity 5*a* of a fuse box.

The fuse box has a matrix of fuse receiving walls. FIG. 1 shows one such receiving wall 5 that forms a fuse cavity 5*a* for receiving the plate-like body 2 of blade type fuse B. The fuse cavity 5*a* has a rectangular opening into which the plate-like body is inserted. Below the fuse cavity 5*a* is provided a double receptacle cavity 5*b* that receives a double receptacle 6. The double receptacle has inwardly folded resilient contacts 6*b* between which the male terminal 3 of the blade type fuse B is inserted, and resilient contacts 6*a* between which the male terminal 7*a* of a bus bar 7 is inserted. The double receptacle 6 is housed in the receptacle cavity 5*b* with some clearance between the inner wall of the receptacle cavity 5*b*.

The fuse cavity 5*a* is formed with a pair of wrong insertion detecting ribs 8, 8 at each longitudinal end of the fuse cavity 5*a*. The wrong insertion detecting ribs 8 are positioned in opposing relation with each other so as to define a receiving groove 9 therebetween. Each rib has a beveled guiding surface 8*a* so that the rib 4 of the blade type fuse is guided into the groove 9 when inserted into the fuse cavity.

Figure 3:
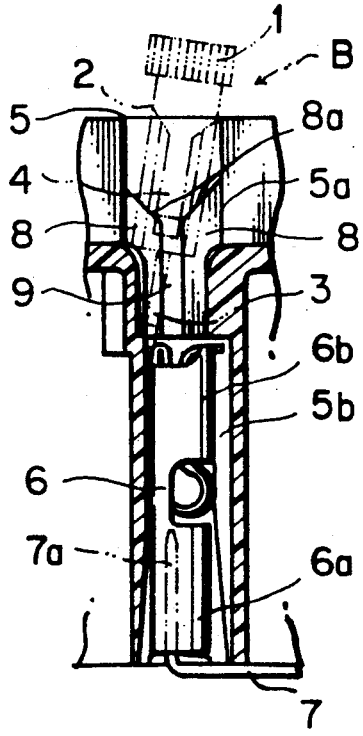
FIG. 3 is another cross-sectional view of FIG. 1 when the blade type fuse is inserted in a wrong direction.
Figure 4:
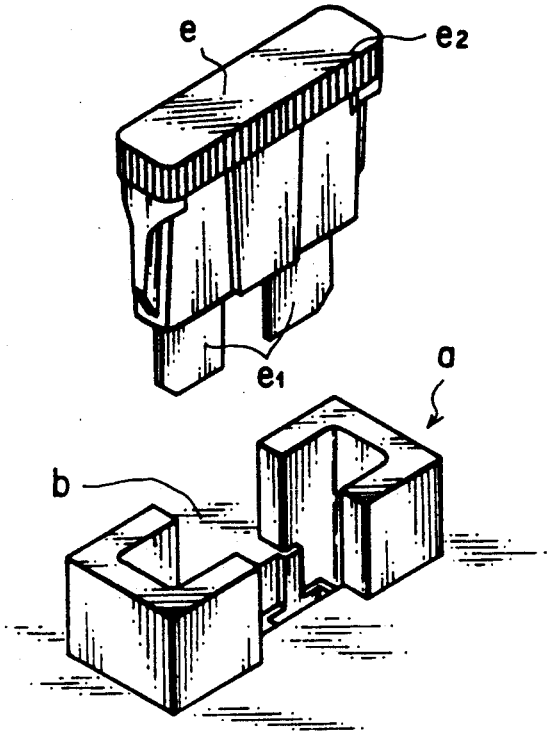
FIG. 4 PRIOR ART
FIG. 4 is a perspective view of a conventional fuse box and a blade-like fuse.
Figure 5:
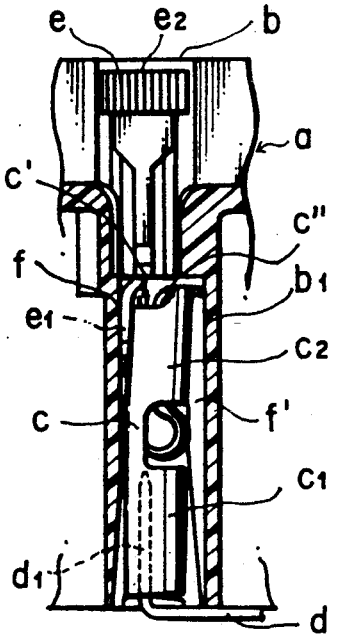
FIG. 5 PRIOR ART
FIG. 5 is a cross-sectional view showing an essential part of the conventional fuse box when a blade type fuse is inserted.

When the blade type fuse B is inserted into the fuse cavity 5*a*, the rib 4 of blade type fuse B is guided by the beveled guiding surfaces 8*a*, 8*a* into the groove 9. The male terminal 3 is guided toward the contact 6*b* of double receptacles 6. If the tip of the male terminal 3 is wrongly inserted, the beveled guiding surface 8*a* of wrong insertion detecting rib 8 blocks the beveled guide surface 4*a* of blade type fuse preventing further insertion of the fuse. Then, the head 1 of the blade type fuse projects outwardly of the opening of fuse cavity 5*a*, as shown in FIG. 3.

What is claimed is:

1. A fuse box comprising a fuse cavity for receiving a body of a blade type fuse having blade-like male terminals projecting from the body into an insertion direction of the blade type fuse, the body having opposed ends extending into said insertion direction and a first rib provided on each of the opposed ends, said first rib extending into the insertion direction, wherein said fuse cavity comprises:

opposed walls between which said opposed ends of said body of the blade type fuse are received when said blade type fuse is inserted; and two pairs of second ribs provided on said opposed walls, each pair being positioned to define a receiving groove therebetween for receiving said first rib of said blade type fuse.

2. A fuse box according to claim 1, wherein each of said second ribs has a beveled guiding surface so that said first rib of said blade type fuse is guided into said receiving groove when said blade type fuse is inserted into said fuse cavity.

3. A fuse box according to claim 2, wherein each of said two pairs of second ribs includes two ribs, each of said two ribs being positioned in opposing relation on each of said opposite walls.

4. A fuse box according to claim 2, wherein said fuse box further includes receptacle cavities provided adjacent said fuse cavity, said receptacle cavities housing receptacles therein for mating said blade-like male terminals of said blade type fuse when said blade type fuse is inserted into said fuse cavity.

* * * * *